US009718063B2

(12) United States Patent
De Weldige

(10) Patent No.: US 9,718,063 B2
(45) Date of Patent: Aug. 1, 2017

(54) PRESS ROLL FOR A ROLL PRESS

(71) Applicant: Eggert De Weldige, Velbert-Langenberg (DE)

(72) Inventor: Eggert De Weldige, Velbert-Langenberg (DE)

(73) Assignee: MASCHINENFABRIK KOEPPERN GMBH & CO. KG, Hattingen (DE)

( * ) Notice: Subject to any disclaimer, the term of this patent is extended or adjusted under 35 U.S.C. 154(b) by 357 days.

(21) Appl. No.: 14/381,053

(22) PCT Filed: Jan. 31, 2013

(86) PCT No.: PCT/EP2013/051966
§ 371 (c)(1),
(2) Date: Aug. 26, 2014

(87) PCT Pub. No.: WO2013/135425
PCT Pub. Date: Sep. 19, 2013

(65) Prior Publication Data

US 2015/0034749 A1 Feb. 5, 2015

(30) Foreign Application Priority Data

Mar. 15, 2012 (DE) ..... 10 2012 102 192

(51) Int. Cl.
*B02C 4/02* (2006.01)
*B02C 4/30* (2006.01)

(52) U.S. Cl.
CPC ..... *B02C 4/305* (2013.01); *B02C 4/02* (2013.01)

(58) Field of Classification Search
CPC ..... B02C 4/02; B02C 4/305
USPC ..... 241/293, 294
See application file for complete search history.

(56) References Cited

U.S. PATENT DOCUMENTS

| | | | | |
|---|---|---|---|---|
| 4,848,683 | A * | 7/1989 | Kawatsu | B02C 2/005 241/294 |
| 5,269,477 | A | 12/1993 | Buchholtz | |
| 5,755,033 | A | 5/1998 | Guenter | |
| 6,086,003 | A | 7/2000 | Guenter | |
| 7,497,396 | B2 | 3/2009 | Splinter | |
| 7,510,135 | B2 | 3/2009 | Burchardt et al. | |
| 2013/0284840 | A1 | 10/2013 | Packeisen | |

FOREIGN PATENT DOCUMENTS

DE 102007007276 A 8/2008

* cited by examiner

*Primary Examiner* — Mark Rosenbaum
(74) *Attorney, Agent, or Firm* — Andrew Wilford

(57) ABSTRACT

The invention relates to a press roll (1) for a roll press, in particular for comminuting highly abrasive materials, comprising a roll body (2) which has a plurality of pocket-like recesses (3) that are distributed over the circumference and are spaced from one another in the circumferential direction (T) on one or both roll edges, each said recess being formed so as to be open laterally and at the top. Only one hard body is removably inserted into each individual pocket-like recess (3) as an exchangeable edge protection element (5), and the length (L) of the pocket-like recesses (3) and the length (I) of the inserted edge protection elements (5) in the circumferential direction (T) is greater than the distance (A) between two directly adjacent recesses (3).

20 Claims, 3 Drawing Sheets

PRESS ROLL FOR A ROLL PRESS

CROSS REFERENCE TO RELATED APPLICATIONS

This application is the US-national stage of PCT application PCT/EP2013/051966 filed 31 Jan. 2013 and claiming the priority of German patent application 102012102192.9 itself filed 15 Mar. 2012.

FIELD OF THE INVENTION

The invention relates to a crush roller for a roller crusher, in particular for comminuting highly abrasive materials, comprising a roller body having a plurality of pockets (for wear protection at the edges) that are distributed angularly and are spaced angularly from one another on one or both roller ends, each such pocket being open axially and radially outward, a single hard body being removably fitted into each individual pocket as a replaceable edge protector.

BACKGROUND OF THE INVENTION

A roller crusher generally has two crush rollers. Roller crushers are used particularly for the comminution, particularly high-pressure comminution, of coarse mineral material, such as ores, cement clinker, slag, kimberlite, coal or ceramic base materials. Roller crushers of this type are also referred to as high compression roller mills. However, the invention also comprises roller crushers for compacting or briquetting material.

In the processing and particularly the comminution of brittle, granular material using such a roller crusher, high forces are applied and the surfaces of the rolls are under great stress, so that protecting the roller surfaces against wear is generally of special importance. Thus it is known in practice to protect roller surfaces against wear by using cylindrical hard metal pins and/or studs that are embedded "hedgehog-like" in corresponding blind bores in the roller body, and together with the material to be crushed between the rolls, form an autogenous layer of wear protection (see EP 0 516 952 [U.S. Pat. No. 5,269,477]). However, this type of wear protection is generally unsatisfactory in the region of the roller ends due to the high risk of the pins breaking off at the edges. For this reason, measures specifically for protecting the edges and/or for wear protection at the edges of the roller have been proposed.

For instance, a generic crush roller is known from EP 0 516 952, in which cylindrical hard metal pins are incorporated into the roller body for wear protection, and pockets that are designed as open axially and radially outward are also provided along the roller ends, with plate-shaped, wear-resistant inserts in the pockets. The spacing between these edge protectors along the angular direction of the roller corresponds approximately to the spacing between the nub pins embedded in the remaining regions of the roll. However, the wear protection thereby achieved at the edges is unsatisfactory.

For this reason, alternative edge protection concepts have been proposed, in which replaceable edge protectors are fitted into angularly extending annular grooves that are open axially and radially outward.

For instance, EP 1 502 650 [EP 7,510,135] describes a crush roller having angularly extending pockets in the form of annular shoulders arranged along the end edges of the roll, wherein in each of these pockets, a plurality of wear protection elements are set one next to the other angularly.

The wear protection elements that are made of hard metal and form a quasi-closed ring that is designed to provide high wear protection. The wear protection elements can be mounted directly in the annular shoulders by gluing, clamping or soldering. In general, the wear protection elements are fastened angularly close to one another and therefore, no autogenous wear protection between the elements is formed.

The same is true of a crush and/or grinding roller known from EP 1 684 907 [U.S. Pat. No. 7,497,396] for the high-pressure comminution of granular material, in which a plurality of hard bodies are arranged on the end face edges in an annular groove of the roller outer surface for the purpose of edge protection, with such hard bodies projecting both axially from the end face and radially from the surface of the roller outer surface.

An alternative wear protection concept is described in EP 0 659 108 [U.S. Pat. No. 5,755,033]. The wear layer of the crush roller essentially has planar zones made of a highly wear-resistant material that can be formed, for example from ceramic tiles and/or glazed tiles. The interstices between the highly wear-resistant zones are filled with a material of different wear resistance. The ceramic tiles and/or glazed tiles can be produced, for example from a metal matrix composite material by hot isostatic pressing. These prefabricated hard bodies are then permanently mounted, together with the interstice material, onto the base body by hot isostatic pressing.

OBJECT OF THE INVENTION

Proceeding from the known above-described prior art, the object of the invention is to provide a crush roller for a roller crusher that is characterized by a particularly resistant but replaceable wear protection along the roller ends.

SUMMARY OF THE INVENTION

To attain this object, the invention teaches that, in a generic crush roller of the type described in the introductory portion with individual pockets along the roller ends, the length of the pockets and the length of the edge protectors used is greater in the tangential direction and/or the angular direction than the spacing between two directly adjacent pockets.

The invention is based on the understanding that it is generally advantageous to equip the crush roller with replaceable and therefore removable edge protectors along the roller ends. Removable within the context of the invention means that these edge protectors can be removed from the pockets without being destroyed, allowing them to be replaced. In this feature, in addition to screw connections and form-fitting connections, connections by gluing or soldering are also included, since these can be released, for example by heating. However, according to the invention, the removable edge protectors are not arranged in angular grooves and/or annular shoulders, and are instead removably fitted into individual pockets, with a single hard body being removably fitted into each individual pocket as a replaceable edge protector. The solution according to the invention has the advantage over the known solutions having annular grooves that the individual edge protectors do not come in contact with one another despite very high compressive forces, and therefore, they will not push against one another and cannot be pressed against one another. As a result, damage to the individual edge protectors is prevented, in particular, damage resulting from breakage that is a particular risk with brittle hard materials. Arranging edge protectors in individual, locally delimited pockets has the further advantage that the edge protectors are supported not only against a stepped shoulder at the bottom side and the inner side, but also axially. Because the roller end has individual, locally delimited pockets, the individual pockets are delimited from one another by "webs," so that the edge protectors are supported tangentially by these webs. The high compressive forces that occur can be easily transmitted into the base body. Finally, the solution according to the invention has the advantage over the known arrangements having angular annular shoulders that, in the region of the webs and therefore in the region between the individual pockets and edge protectors, autogenous wear protection can form that protects the edges of the wear protection elements used to a special degree. The autogenous wear protection can thereby be established not only in the remaining roller regions, but also in the edge region and between the individual wear protection elements. As a result, erosive wear in these zones is avoided. With the known solutions having angular annular shoulders, the problem exists that erosion, particularly in the region of joints between the individual segments, can result in material being pressed into the pockets that are produced. This causes deflection of the elements that can result in cracking of the brittle elements, particularly if the edge protectors are made of hard metal.

The pockets—as described—are designed such that each is open axially and radially outward. Within the scope of the invention, open axially means open at the end face relative to the roller, in other words open axially on the side that faces away from the center of the roller. Open radially outward, within the scope of the invention, means open on the side that faces away from the roller axis in the radial direction. This will be discussed in detail in the description of the figures.

Although processing according to the invention involves individual pockets that are open axially and radially outward—in contrast to the known concepts having angular annular shoulders —, the crush roller according to the invention is characterized by reliable edge protection over the entire angular extent of the crush roller. This is because the (angular) length of the pockets and therefore also the angular length of the inserted edge protectors is (significantly) greater than the (angular) spacing between two directly adjacent pockets, and is therefore significantly greater than the thickness of the webs between the individual pockets. Preferably, the length of the pockets and the length of the edge protectors are more than two times, preferably more than five times, particularly preferably more than ten times the spacing between the individual pockets. The relatively small spacing between the pockets, as compared with the length of the pockets, has the further advantage that autogenous wear protection can also easily form in the edge region. Nevertheless, the webs between the pockets provide enough stability to achieve the above-described advantages. For this purpose, the invention proposes in an advantageous development that the (angular) spacing between two directly adjacent pockets is more than 3 mm, preferably more than 4 mm.

The edge protectors in the individual pockets can have the most varied geometric forms. Preferably, edge protectors are used that are designed as angular, for example rectangular viewed radially of the roller surface. It is within the scope of the invention that the edge protectors are also designed as angular, for example rectangular, from an axial end view of the roll, giving the edge protectors the form of a rectangular prism, for example. Alternatively, however, the invention also includes edge protectors of different geometries that can also have a non-angular form, particularly when viewed radially.

Particularly preferably, edge protectors having a form other than that of a rectangular prism are used. For instance, the invention proposes that the axial pockets preferably have curved wall surfaces, at least in regions, from an axial end view, and the edge protectors have a curved outer surface, adapted to the curved wall surface, at least in regions. For instance, the (locally) curved wall surface of the pocket and the (locally) curved outer surface can be designed as arcuate in cross-section or alternatively as parabolic in cross-section. In any case, the above-described axial support of the edge protectors and therefore the deflection of the pressure forces into the base body can thereby be optimized. Moreover, such pockets having curved wall regions and/or base regions can be formed particularly easily into the base body, for example by milling.

The advantages according to the invention can be achieved using edge protectors made of the widest variety of materials. For instance, it is within the scope of the invention for the edge protectors that are removably fitted into the pockets, to be made of hard metal or hard metal-like materials, for example cermets. Preferably, however, edge protectors made of metal matrix composite (MMC) can be used according to the invention. These edge protectors made of MMC have the advantage over those made of hard metal that, with a suitable selection of the matrix materials, the proportion of which is substantially greater than that of hard metal in the MMC, the edge protectors can be less brittle, and therefore as less sensitive to bending. The selected composition of the material also allows the wear to be "adjusted." In practice, it has long been a problem that the pressure in the region of the roller ends is generally lower than at the center region of the roll. As a result, the edge protectors wear more slowly, causing the rolls to become "thinner" at the roller center and/or to take on a "concave" geometry. In extreme cases, this can even result in insufficient comminution of the material at the center of the roll. These disadvantages can be avoided, for example by using suitable edge protectors made of metal matrix composites having wear properties and rates that are appropriate for the particular use. A metal matrix composite is a material in which hard particles are incorporated into a coherent metal matrix, the hard particles being separate from one another throughout the coherent metal matrix within the composite material. Edge protectors made of a metal matrix composite are preferably produced by sintering and/or hot isostatic pressing. The non-metal hard particles are distributed within the finished material and are each encompassed by the metal material of the metal matrix. The metal matrix composites therefore differ from the hard metals, for example, in terms of the relatively low ratio of hard particles. The hard particles of the metal matrix composites are also significantly larger than the hard particles of hard metals. Within the scope of the invention, a metal matrix composite is preferably used in which hard particles greater than 20 μm in size, for example greater than 40 μm (preferably greater than 60 μm), and having a volume ratio of less than 50% (preferably less than 40%) are used that are (discontinuously) embedded in a (coherent) metal matrix. In each case, this refers to the volume ratios in the (pressed) hard body.

In principle, it is within the scope of the invention that the edge protectors are substantially homogeneous solid bodies, for example made of hard metal, cermet or MMC. In an alternative, preferred embodiment, however, the edge protectors can have a composite structure, with each element comprising a support element with a wear layer arranged thereupon or thereon, the support element consisting of a ductile material of lower hardness than the wear layer. This embodiment has the advantage that the support element can be made of a readily processable material, for example steel that particularly enables an optimal mounting of the edge protector on the roller body. The wear layer itself then forms the wear protection. The wear layer of the edge protector can consist, for example of hard metal or a hard metal-like material, for example cermet, or—as described above—a metal matrix composite (MMC). This wear layer is securely attached to the support element during manufacture of the edge protectors, for example by sintering and/or hot isostatic pressing (HIP).

The wear layer applied to the support element can cover the entire surface of the support element, and can therefore form the entire outer surface of the edge protector. Alternatively, however, the wear layer can cover only part of the support element. For instance, it is possible, for example to incorporate a recess into the support element, into which recess the wear layer is then integrated as a wear insert.

The edge protectors according to the invention are removably attached to the roller body, and therefore, the edge protectors are in principle replaceable. Such attachment is achieved for example by a screw connection. For this purpose, the edge protectors can have suitable openings, for example bores, through which corresponding fastening elements, for example screws, can be fitted into the roller body. Such an embodiment is considered particularly when the edge protector has a support element made of a ductile material, for example steel. Alternatively, it is within the scope of the invention to fasten the edge protectors in the pockets (removably) by gluing or soldering. Alternatively or additionally, a form-fitting connection of the edge protectors in the pockets is also possible, specifically by a "dovetail connection," for example. For this purpose, the edge protectors can be equipped with (for example dovetail) form-fitting lands that engage in a form-fitting manner in complementary negative grooves in the pockets.

The webs arranged between the individual pockets and/or pockets can have a constant axial dimension. Optionally, however, this thickness may also vary across the width of the pocket. For instance, the thickness of the web may increase or decrease axially from the roller end toward the roller center.

To further optimize the fastening of the edge protectors in the pockets and/or the introduction of the compressive forces into the roller body, the pockets and the edge protectors can each have a radial depth that increases, at least in some areas, toward the axial center of the roller. Therefore, the radial depth can widen and/or can widen in some areas from the roller end face toward the roller axis, so that the (inner) surface of the edge protectors, each of which faces the center of the roller in the axial direction, is larger than the (outer) surface that faces the roller end face. The shape of the pockets and/or pockets is correspondingly "negative" in design. As a result, the edge protectors are connected at their outer surfaces to the roller in a form-fitting manner, so that they are prevented from falling out during assembly.

The subject matter of the invention is not only the described crush roller, but in a preferred development, is also a roller crusher having two such crush rollers.

Moreover, the crush roller can be designed as a solid roll, that is, the roller body is designed as a solid body. Alternatively, the roller body can also have a (cylindrical) base body on which is fitted a jacket, in which case the wear protection is mounted onto/on such jacket.

The pockets can be incorporated into the base body, that is, into the solid body or into the jacket, for example by machining, forming the webs.

BRIEF DESCRIPTION OF THE DRAWING

In the following, the invention will be described in greater detail with reference to a drawing that illustrates embodiments. In the drawing.

SPECIFIC DESCRIPTION OF THE INVENTION

Figure 1:
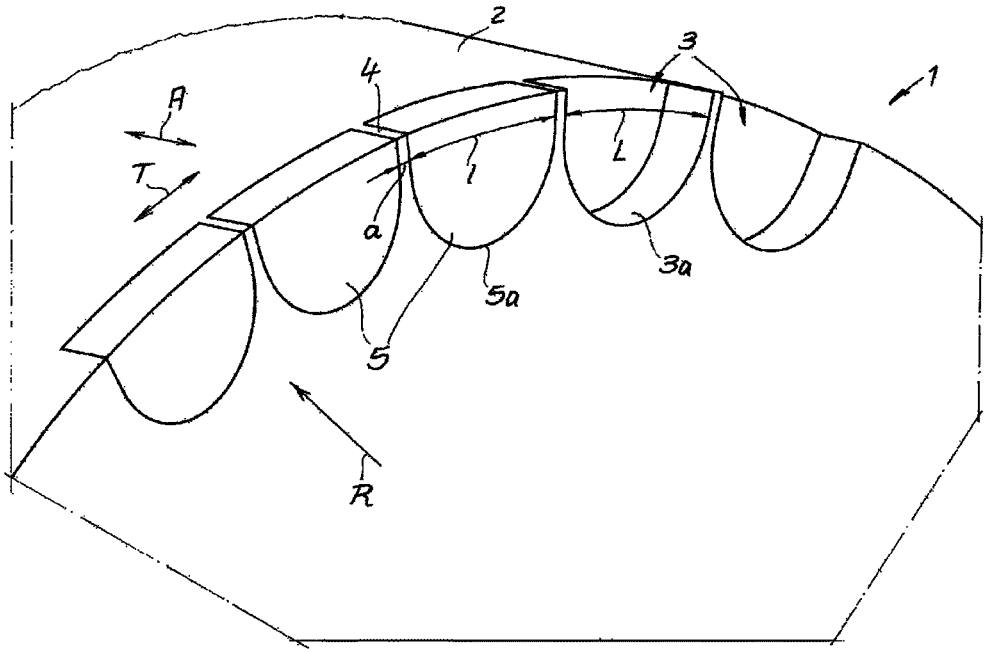
FIG. 1 is a perspective view of a detail of crush roller according to the invention in a first embodiment.

Each of the figures shows a crush roller 1 for a roller crusher, in particular for the high-pressure comminution of brittle, mineral feed material. The roller crusher generally consists of two crush rollers 1, only a part of one of which is shown in the drawing. Such a crush roller 1 can—as shown in the drawing—be a solid roll, in which case the roller body 2 is designed as a solid body. Alternatively, however, the roller body can also have a base body and a jacket surrounding the base body. This option is not shown in the drawing.

In any case, such a crush roller is equipped with suitable wear protection that can be of various designs. The illustrations in the drawing are limited to wear protection measures in the region of the (end face) roller ends.

For the wear protection in the region of the roller ends, the roller body 2 has, on one or both roller end edges, a plurality of pockets 3 distributed angularly and spaced from one another angularly in a tangential/angular direction T. The individual pockets 3 are separated from one another in the angular direction T by webs 4. Each of the pockets is open both axially and radially outward. A single hard body as a replaceable edge protector 5 is removably fitted into each of the individual pockets 3. The drawing shows the crush roller 1 in a partially assembled state, that is, a number of pockets 3 are shown without their edge protectors inserted, in the interest of clarity.

Also indicated in FIG. 1 are the angular/tangential direction T, the axial direction A and the radial direction R. As has already been described, the individual pockets 3 are each open both axially and radially outward. Open axially therefore means open at the end face, i.e. on the side that faces away from the roller axis, in the axial direction A. Open radially outward means open on the side that faces away from the roller axis, in the radial direction R.

Therefore, in the embodiment according to the invention, the known angular and continuously annular shoulders at the roller ends are dispensed with. Instead, individual recesses, and therefore pockets 3 are proposed, into each of which only a single edge protector 5 is fitted. According to the invention, the angular length L of the pockets and the angular length 1 of the fitted edge protectors 5 is greater than the angular spacing a between two directly adjacent pockets 3. The lengths L, 1 and the spacing a refer to the angular direction T of the roll, specifically in the region of the radial outer edges of the edge protectors. The spacing a between the individual pockets 3 therefore corresponds to the thickness of the webs 4, which are part of the roller body 2, between the pockets 3 and therefore also between the edge protectors 5. The pockets 3 are formed the roller body 2 for example by machining.

With the embodiment according to the invention with individual pockets 3, the individual edge protectors 5 that are hard bodies do not come in contact with one another, and cannot be pressed against one another despite the high forces that occur, thereby preventing damage to these edge protectors. Moreover, with this embodiment, the compressive forces that occur can be easily passed to the roller body 2. This applies, in particular, to the embodiment illustrated in the drawing, in which the axial pockets 3 from the axial end view have a curved wall and/or base 3*a*, and the edge protectors 5 have a curved outer surface 5*a* that is complementary to the curved wall 3*a*. In the embodiment according to FIGS. 1 to 3, both the curved wall region 3*a* and the curved outer surface 5*a* are part-cylindrical.

FIG. 1 shows a first embodiment in which the edge protectors 5 are made "homogeneously" of one and the same material. Such elements can be, for example hard bodies made of hard metal or hard metal-like materials (for example cermets). Alternatively, the hard bodies can also be made of a metal matrix composite. In the embodiment shown in FIG. 1, the edge protectors and/or hard bodies 5 are secured in the pockets without screws, for example by gluing or soldering.

Figure 2:
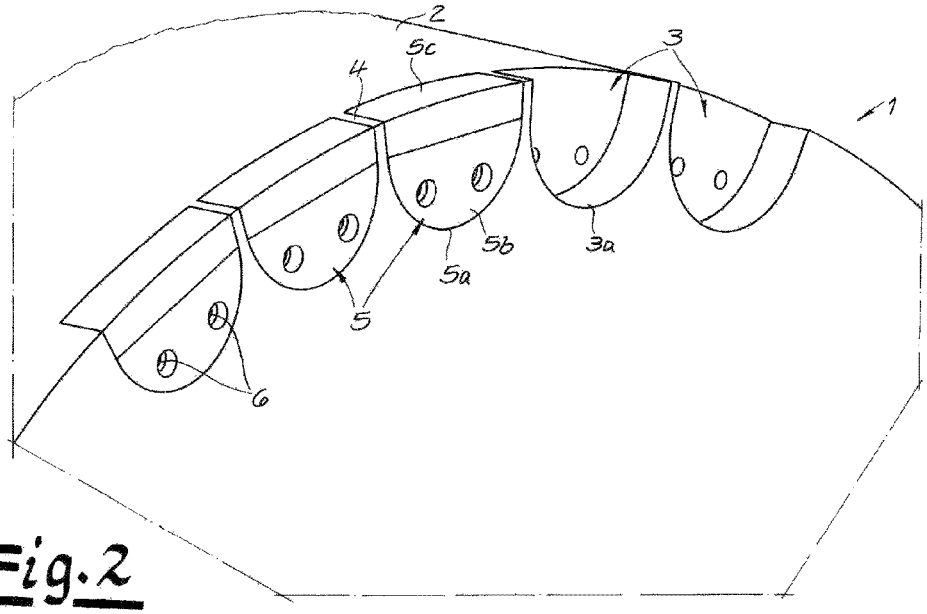
FIG. 2 shows the crush roller of FIG. 1 in a modified second embodiment.

In an alternative embodiment, FIG. 2 shows edge protectors 5 that each has, as a composite structure, a support element 5*b* and a wear layer 5*c* carried thereby. The support element 5*b* consists of a ductile material, for example steel. The support elements 5*b* are therefore used primarily for fastening the edge protectors 5 in the respective pockets 3, whereas the wear layer 5*c* determines the edge protection properties and/or wear properties. For this purpose, the wear layer 5*c* can be made, for example of a hard metal or a hard metal-like material (for example cermet), or preferably also of a metal matrix composite. In this case, it is advantageous for the wear layer to be attached to the support element 5*b* by sintering and/or hot isostatic pressing. During manufacture, the individual edge protectors 5 comprising the support element 5*b* and the wear layer 5*c* are therefore prefabricated and are then installed in the pockets 3.

FIG. 2 shows an embodiment in which the edge protectors 5 are attached to the roller body 2 by screws. The edge protectors 5 therefore have suitable openings 6 and/or bores through which the screws can be inserted into the roller body 2. In the embodiment of FIG. 2, these bores 6 for the screws are in the support elements 5 and therefore in ductile material.

Figure 3:
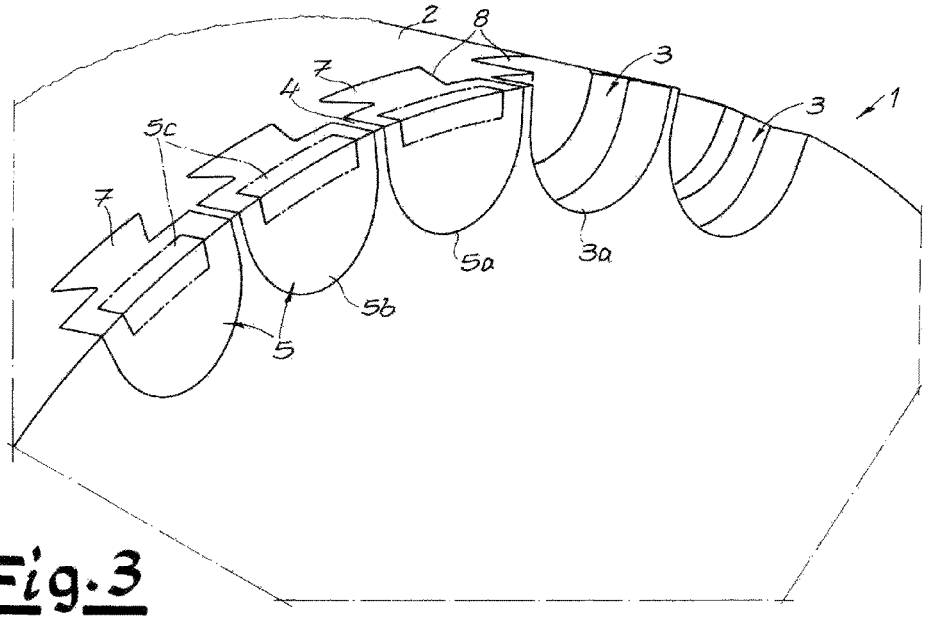
FIG. 3 shows the crush roller of FIG. 1 in a modified third embodiment.

FIG. 3 shows an alternative embodiment in which the edge protectors 5 are attached to the roller body 2 in a form-fitting manner, specifically by a dovetail. For this purpose, each of the edge protectors 5 has a mounting land 7, and in the region of each of the individual pockets 3, a groove 8 extending in the radial direction is arranged in the roller body 2, both the mounting lands and the grooves 8 being of complementary dovetail shape. Despite this form-fitting connection, it can be advantageous to also fasten the edge protectors 5 in the pockets 3 by gluing or soldering.

FIG. 3 optionally illustrates that these elements 5 can also be a composite component having a wear layer 5*c* and a support element 5*b*, the wear layer 5*c* being formed by a wear insert 5*c* that is fitted into a complementary recess of the support element 5*b*.

The edge protectors 5 shown in the drawing are rectangular on the roller as viewed radially. From an axial end view of the end face of the roll, however, the edge protectors 5 in the embodiment—as described—are rounded in some areas. In principle, the invention also comprises embodiments in which the edge protectors are designed as polygonal, for example rectangular, from an axial end view of the end face, so that edge protectors in the form of a rectangular prism, for example can also be achieved. This is not shown in the drawing.

It is also within the scope of the invention to alternatively or additionally provide the radial outer sides of the edge protectors with a curved shape, resulting, in particular, in an adaptation to the radius of curvature of the roll. This option is not illustrated.

Figure 4:
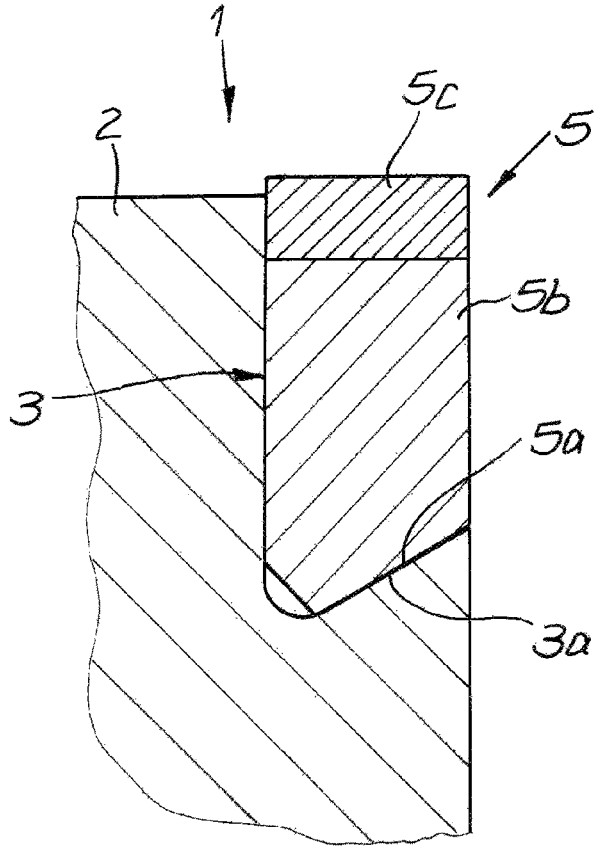
FIG. 4 is a cross-section of a modified embodiment of the invention, FIG. 5 a further option of the invention.
Figure 5:
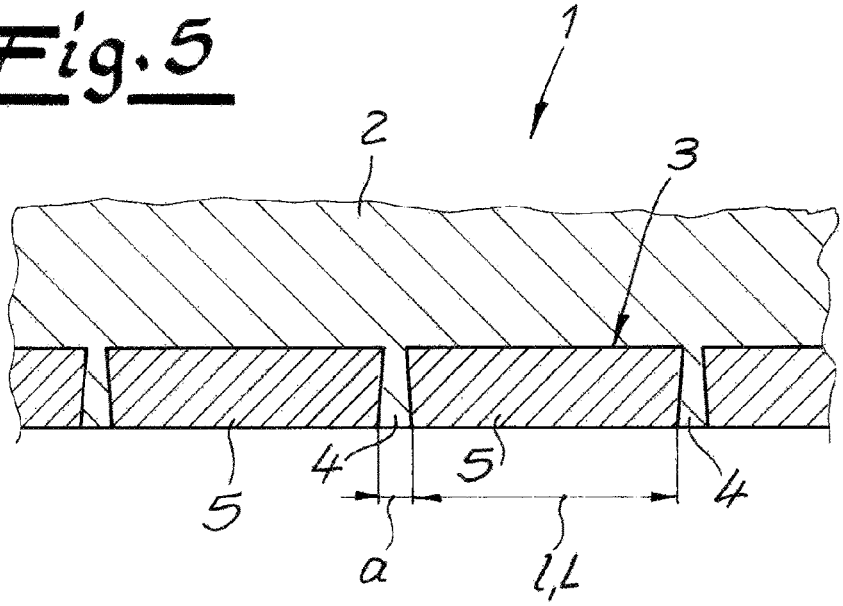

It is further within the scope of the invention—as described—for the radial depth of the pockets 3 and of the edge protectors 5 to widen, at least in some areas, axially toward the center of the roll. These options are illustrated by way of example in FIGS. 4 and 5. FIG. 4 shows an embodiment in which the radial inner wall 3*a* drops radially inward from the roller end axially toward the roller axis, forming a sloped bottom edge. The same is true of the corresponding lower outer surface 5*a* of the edge protector 5. This embodiment has the effect that the edge protectors are securely pressed into the pockets by the compressive forces that occur. Such an embodiment can be achieved in edge protectors of the most varied forms, for example also in the edge protectors shown in FIGS. 1 to 3. This applies likewise to the option illustrated in FIG. 5. There as well, the pockets 3 and the edge protectors 5 have a radial depth that increases in radial dimension axially toward the roller axis, at least in some areas, and in FIG. 5 this refers to the axial wall regions and/or the axial outer surface. The considerations on which FIG. 4 is based can therefore also be provided according to FIG. 5 in the axial regions of the pockets, and these options may also be combined with one another.

The invention claimed is:

1. A crush roller for a roller crusher for comminuting highly abrasive materials, comprising a roller body having a plurality of pockets that are distributed angularly and are spaced from one another in an angular direction on one or both roller end faces, each such pocket being open axially outward at a roller end face and radially outward at a cylindrical roller outer surface, a single hard body being inserted as a replaceable edge protector into each individual pocket, wherein the length of the pockets and the length of the inserted edge protectors in the angular direction at radial outer edges of the edge protectors are greater than five times the spacing between two directly adjacent pockets at the roller outer surface.

2. The crush roller according to claim 1, wherein the length of the pockets and the length of the edge protectors at the radial outer edges is more than ten times the spacing at the radial outer edges.

3. The crush roller according to claim 1, wherein the spacing between two directly adjacent pockets at the radial outer edges is more than 3 mm.

4. The crush roller according to claim 1, wherein the edge protectors are rectangular seen radially of the roll.

5. The crush roller according to claim 1, wherein the axial pockets have curved wall surfaces from an axial end view, at least in some areas, and the edge protectors have a curved outer surface that is complementary at least in some areas to the curved wall surface.

6. The crush roller according to claim 5, wherein the curved wall surfaces of the pockets or the curved outer surfaces of the edge protectors are arcuate, parabolic, or hyperbolic.

7. The crush roller according to claim 1, wherein each of the edge protectors has a support element with a wear layer carried thereon, the support element being made of a ductile material of lower hardness than the wear layer.

8. The crush roller according to claim 7, wherein the edge protectors or the wear layers thereof are made of hard metal or a hard metal-like material or a metal matrix composite.

9. The crush roller according to claim 7, wherein the wear layer is attached onto or on the support element by sintering or hot isostatic pressing.

10. The crush roller according to claim 1, wherein the support elements are made of steel.

11. The crush roller according to claim 1, wherein the edge protectors or the support elements thereof are removably attached to the roller body by screwing, gluing or soldering.

12. The crush roller according to claim 1, wherein the edge protectors are removably attached to the roller body by a form-fitting connection.

13. The crush roller according to claim 1, wherein the spacing between two angularly adjacent pockets decreases or increases radially from a roller outer surface toward the roller axis.

14. The crush roller according to claim 1, wherein a depth of the pockets and of the edge protectors widens, at least in some areas, axially toward a center.

15. A roller crusher having two crush rollers according to claim 1.

16. A crush roller comprising:

a cylindrical roller body rotatable about an axis and having axially oppositely directed end faces and a radially outwardly directed cylindrical outer surface;

a respective row of radially outwardly and axially outwardly open pockets of generally semicylindrical shape formed at each of the end faces, each pocket opening radially outward at the outer roller-body surface and axially outward at the respective roller-body end face, the roller body being formed between the pockets with webs having radial outer ends flush with the roller-body outer surface;

respective edge protectors fitting complementary in the pockets and having radially outwardly directed outer faces generally flush with the roller-body outer surface, the edge protectors being at the respective outer faces at least partially of a wear-resistant material significantly harder than the roller body, the protectors each being at the roller-body outer surface of an angular length at least five times as great as an angular length of the webs at the roller-body outer surface.

17. The crush roller defined in claim 16, wherein the webs are unitary with the roller body.

18. The crush roller defined in claim 17, wherein outer edge faces of the edge protectors are part-cylindrical and flush with the roller-body outer surface.

19. The crush roller defined in claim 17, wherein the protectors are generally semicircular and of uniform axial thickness.

20. The crush roller defined in claim 17, further comprising means fastening each of the protectors releasably in the respective pocket.

* * * * *